US011761440B2

(12) United States Patent
Lee et al.

(10) Patent No.: US 11,761,440 B2
(45) Date of Patent: Sep. 19, 2023

(54) DUAL PUMP SMART CONTROL SYSTEM

(71) Applicant: Changsoo Lee, Daegu (KR)

(72) Inventors: Changsoo Lee, Daegu (KR); Jaegeun Sung, Daegu (KR); Jinha Kim, Gyeongsan-si (KR)

(73) Assignee: Changsoo Lee, Daegu (KR)

( * ) Notice: Subject to any disclaimer, the term of this patent is extended or adjusted under 35 U.S.C. 154(b) by 0 days.

(21) Appl. No.: 17/745,086

(22) Filed: May 16, 2022

(65) Prior Publication Data

US 2023/0193894 A1 Jun. 22, 2023

(30) Foreign Application Priority Data

Dec. 20, 2021 (KR) ..... 10-2021-0182589

(51) Int. Cl.
*F04B 49/02* (2006.01)
*F04B 49/06* (2006.01)
*F04B 23/04* (2006.01)

(52) U.S. Cl.
CPC ..... *F04B 49/02* (2013.01); *F04B 23/04* (2013.01); *F04B 49/065* (2013.01); *F04B 2203/0201* (2013.01); *F04B 2207/043* (2013.01)

(58) Field of Classification Search
CPC ..... F04B 49/02; F04B 49/065; F04B 23/04; F04B 2203/0201; F04B 2207/043
See application file for complete search history.

(56) References Cited

U.S. PATENT DOCUMENTS

| | | | | |
|---|---|---|---|---|
| 6,709,362 | B2 * | 3/2004 | Tomohiro | F04B 49/02 477/3 |
| 6,807,816 | B2 * | 10/2004 | Lee | F25B 13/00 236/1 EA |
| 8,289,149 | B2 * | 10/2012 | Teramoto | F04B 49/02 340/532 |
| 8,459,957 | B2 * | 6/2013 | Takeda | F04C 29/026 417/438 |
| 8,892,263 | B1 * | 11/2014 | Morris | G05D 7/0623 700/282 |
| 9,637,202 | B2 * | 5/2017 | Russick | G05D 9/12 |
| 9,846,104 | B1 * | 12/2017 | Thompson | G01M 3/226 |
| 9,958,169 | B2 * | 5/2018 | Li | F24D 19/1006 |
| 10,746,171 | B2 * | 8/2020 | Komori | F04B 49/20 |
| 11,603,833 | B2 * | 3/2023 | Brown | F04B 39/06 |
| 2021/0230988 | A1 * | 7/2021 | Ingebrand | F04B 7/0076 |

FOREIGN PATENT DOCUMENTS

| | | |
|---|---|---|
| JP | 1994-299988 A | 10/1994 |
| JP | 2019-80382 A | 5/2019 |

* cited by examiner

*Primary Examiner* — Christopher S Bobish
(74) *Attorney, Agent, or Firm* — NSIP Law

(57) ABSTRACT

A dual pump smart control system. The operating time and the number of simultaneous operations are analyzed and compared with a reference time and a reference number, so that a controller determines whether or not the operation is normal. Afterwards, the driving of a first pump and the driving of a second pump are differentially controlled depending on whether or not the operation is determined to be normal by the controller. Thus, a malfunction caused by the concentration of load at a specific pump is prevented. Accordingly, the dual pump smart control system precisely controls the driving of the dual pumps and enables the pumps to operate efficiently.

6 Claims, 6 Drawing Sheets

DUAL PUMP SMART CONTROL SYSTEM

CROSS-REFERENCE TO RELATED APPLICATIONS

The present application claims the benefit under 35 U.S.C. § 119 of Korean Patent Application No. 10-2021-0182589, filed on Dec. 20, 2021, in the Korean Intellectual Property Office, the entire disclosure of which is incorporated herein by reference for all purposes.

BACKGROUND

Field

The present disclosure relates to a dual pump smart control system and, more particularly, to a dual pump smart control system configured to precisely control the driving of dual pumps depending on the determination of a controller.

Description of Related Art

Recently, a booster pump system has been widely used. Such a booster pump system is configured to maintain a predetermined level of pressure using a plurality of pumps which have the same flow rate and pressure while being connected in parallel. The booster pump system is also configured to sequentially operate the pumps depending on the flow rate of fluid supplied or discharged through the pumps. The booster pump system is typically used in large buildings. In general, the booster pump system is used for water supply pumps, and is provided to drive the pumps according to the amount of water used in an apartment complex or a large building.

When only a single pump is used in an apartment complex, a large building, or a negative pressure ward of a hospital, an amount of fluid to be used should be provided only using the single pump, and thus it is difficult to ensure the required supply or discharge of fluid necessary for an installation environment. In addition, the fluid may have an excessively high flow rate and an unnecessarily excessive amount of energy may be used.

However, when a plurality of pumps having the same flow rate are connected in series using a booster pump system so as to properly operate in response to changes within a flow rate, the pumps may be operated efficiently without an excessive flow rate or unnecessary energy consumption.

Regarding the booster pump system of the related art as described above, disclosed is Korean Patent No. 10-1458812, titled "BOOSTER PUMP CONTROL SYSTEM INCLUDING DUAL REPLACEMENT CONTROLLER."

The related art relates to a power control system for a water supply pump and an emergency replacement power supply apparatus suitable to be used for the power control system. The related art provides a water supply pump control system used in a water supply system including one or more inverters to drive a pump. The water supply pump control system includes a straight pump driving power source and an emergency replacement power supply apparatus. The straight pump driving power source is connected to a power source group of the inverters, and includes a straight driving switch control unit, a power source control unit, a straight driving manual control unit connected to the straight driving switch control unit and the power source control unit, and an inverter control unit. The emergency replacement power supply apparatus is connected to the straight driving switch control unit and the inverter control unit.

When an inverter in charge of the inverter operation of the pump malfunctions (or fails), the above-described booster pump control system ensures the operation of the inverter and, in an emergency, uses the emergency replacement power supply apparatus so as to constantly facilitate the operation of the pump.

However, such a booster pump control system may be close to a countermeasure against the malfunction, and disadvantageously, does not have any configuration for preventing the malfunction from occurring or maximizing the efficiency of an operation by precise control of the pump.

Therefore, in order to overcome the above-described problems, the need to develop a smart control system configured to differentially and precisely control the driving of the dual pumps according to whether or not the operation is determined to be normal is increasing.

SUMMARY

The present disclosure is intended to precisely and differentially control the driving of first and second pumps of dual pumps according to whether or not each of the pumps is determined to be operating normally by a controller.

The present disclosure is also intended to precisely and differentially control the driving of the first and second pumps by reflecting operating times, the number of simultaneous operations, and real-time duty ratios.

The present disclosure is also intended to precisely and differentially control gradual increases in a set duty ratio and the operation of the pumps in a drop section while ensuring the set duty ratio when the drop section in which a real-time duty ratio value is less than a set duty ratio value is present.

According to an aspect, a dual pump smart control system may include: first and second pumps; and a controller. The controller may include: an operating time acquisition module to acquire operating times of the first and second pumps; a first determination module to perform first determination of whether or not an operation is normal by comparing the operating times with predetermined reference times; a second determination module including a simultaneous operation acquisition portion to acquire the number of simultaneous operations of the first and second pumps on basis of the operating times and a second determination portion to perform second determination of whether or not the operation is normal by comparing the number of the simultaneous operations with a predetermined reference number; and a driving control module to differentially control the driving of the first pump and the driving of the second pump according to a result of the determination of whether or not the operation is normal.

In addition, the controller may also include a third determination module comprising a duty ratio input portion to receive set duty ratios of the first and second pumps, a duty ratio acquisition portion to acquire real-time duty ratios of the first and second pumps on basis of the operating time and the set duty ratios, and a third determination portion to perform third determination of whether or not the operation is normal by comparing the real-time duty ratios and predetermined reference duty ratios.

Furthermore, the controller may also include: a learning module including a data generator to generate data in which duty ratios over the operating times of the first and second pumps operated in the past are drawn on a single graph and store the generated data in a learning database and a drop section acquisition portion to extract a longest long operating time among the operating times in which the first pump is operating alone from the graph and acquire a plurality of drop sections each having a real-time duty ratio lower than the set duty ratio from the long operating time; and a driving re-adjustment module to increase the set duty ratios and reduce a time of the last drop section of the plurality of drop sections by extracting learning data, set duty ratios of which are the same as the set duty ratios received by the duty ratio input portion, and re-adjusting the operating times and the set duty ratios of the first pump.

The dual pump smart control system according to the present disclosure provides the following advantages:

1) The operating time and the number of simultaneous operations are analyzed and compared with the reference time and the reference number, so that the controller determines whether or not the operation is normal. Afterwards, the driving of the first pump and the driving of the second pump are differentially controlled depending on whether or not the operation is determined to be normal by the controller. Thus, a malfunction that would be caused by the concentration of load at a specific pump may be prevented. Accordingly, the dual pump smart control system can precisely control the driving of the dual pumps and enable the pumps to operate efficiently.

2) In addition to the configuration of determining whether or not the operation is normal on the basis of the duty ratio, the driving may be precisely controlled by rapidly detecting the concentration of load applied to a specific pump and determining whether or not the operation is normal according to the detection, so that the specific pump may be prevented from the concentration of load or fatigue. Consequently, the pump can be prevented from malfunctioning, and thus the lifetime of the pump can be increased.

3) In a section in which output power may be reduced by the real-time duty ratio being less than the set duty ratio, a set duty value can be automatically increased by the controller. It is possible to precisely control the pumps to maintain the output power of the pumps at the levels of set values while preventing the pumps from overloading or the accumulation of fatigue.

DETAILED DESCRIPTION

Figure 1:
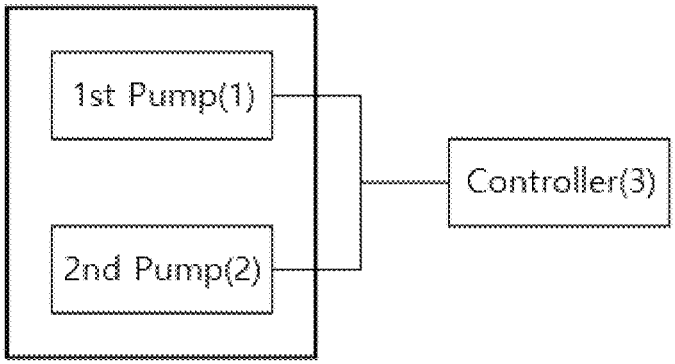
FIG. 1 is a block diagram illustrating a schematic configuration of a system according to the present disclosure.

Hereinafter, exemplary embodiments of the present disclosure will be described in detail with reference to the accompanying drawings. It should be understood that the accompanying drawings may not be drawn to scale, and the same or like reference numerals may be used to refer to the same or like elements throughout the drawings.

Referring to FIG. 1, a dual pump smart control system according to the present disclosure may generally include first and second pumps 1 and 2 and a controller 3.

Each of the first and second pumps 1 and 2 is configured to discharge fluid to a supply pipe or provide positive pressure or negative pressure to an interior space through the supply pipe. Here, the first and second pumps 1 and 2 are characterized by being pumps capable of supplying the same pressure.

Thus, when one of the dual pumps is the first pump 1, the other of the dual pumps is the second pump 2. Each of the first pump 1 and the second pump 2 may be connected to a pipe to discharge fluid through the pipe, or serve to provide positive pressure or negative pressure.

The controller 3 serves to determine whether or not each of the first and second pumps 1 and 2 is operating normally and differentially controlling the driving of the first pump 1 and the driving of the second pump 2 on the basis of the determination. Here, the controller 3 may have an automation control function based on a logic.

Thus, the present disclosure is characterized by differentially controlling the driving of the first pump 1 and the driving of the second pump 2 of the dual pumps by determining whether or not the pumps are operating normally on the basis of a logic. Consequently, the overloading and malfunction (or failure) of one of the dual pumps may be prevented, and the overconsumption of energy may be minimized, thereby enabling efficient operation of the pumps.

In addition, the controller 3 may be provided with a separate database (DB) server and thus automatically control the driving of the first pump 1 and the driving of the second pump 2 on the basis of data stored in the DB server. In addition, when no separate DB server is provided, the controller 3 may be provided with its own storage means, such as a hard disk, and store data for automation control in the hard disk. Here, the storage means, such as a disk, may be an embedded type internally mounted on a processor.

In other words, linked data used for the controller 3 to determine whether or not the operation is normal on the basis of the logic may be stored in the DB server, which may be provided separately from the controller 3, or the storage means, such as a hard disk or a memory, which may be configured integrally with the controller 3 or internally mounted on a mechanical device of the controller 3, such that whether or not the operation is normal may be determined using the logic on the basis of the stored data.

A program, i.e., software, executable by a central processing unit (CPU) of a hardware configuration including a storage means, such as a memory and a hard disk, in addition to the CPU, may be installed in and executed by the controller 3. A series of specific configurations of such software will be described later as components, such as "modules," "units," and "parts."

Components, such as "modules," "units," "parts," or "interfaces," may be components of software, which is installed and stored in the storage means of the controller 3 to be executed by means of the CPU and the memory, or hardware, such as an FPGA or an ASIC.

Here, the components, such as "modules," "units," "parts," or "interfaces," are not limited to the above. Such components may be configured to be disposed in an addressable storage medium or to regenerate one or more processors.

For example, the "modules," "units," "parts," or "interfaces" may include various types of elements (e.g., software elements, object-oriented software elements, class elements, and task elements), segments (e.g., processes, functions, achieves, attributes, procedures, sub-routines, program codes, etc.), drivers, firmware, micro-codes, circuit, data, database, data structures, tables, arrays, and variables.

Functions provided by the "modules," "units," "parts," or "interfaces" may be formed by combining a small number of elements and "units" or "modules" or may be divided into additional elements and "units" or "modules."

In addition, the controller 3 may mean any type of hardware device including at least one processor, and according to embodiments, may be interpreted as including a software component operating in the hardware device.

Figure 2:
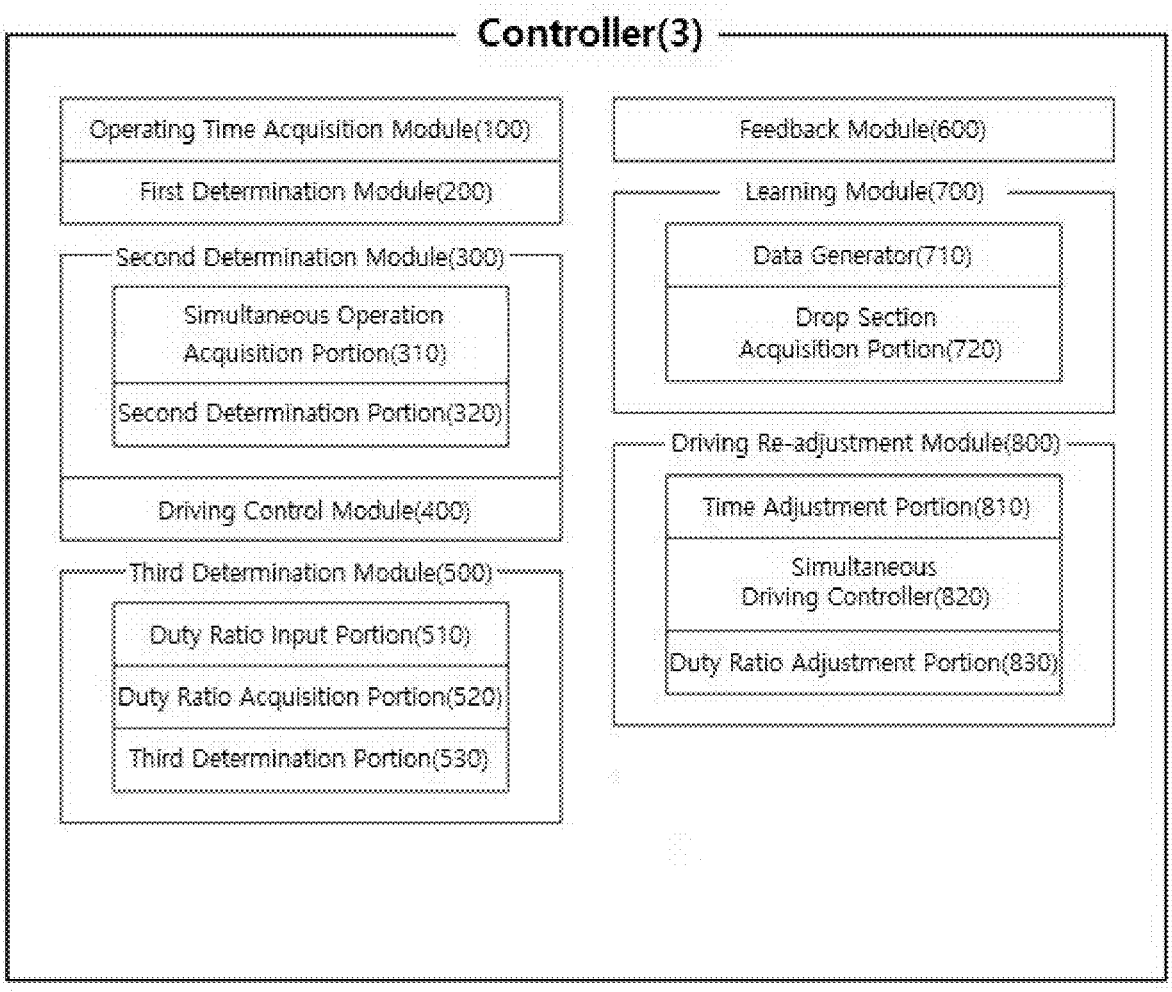
FIG. 2 is a block diagram illustrating an overall configuration of the controller of the system according to the present disclosure.
Figure 3:
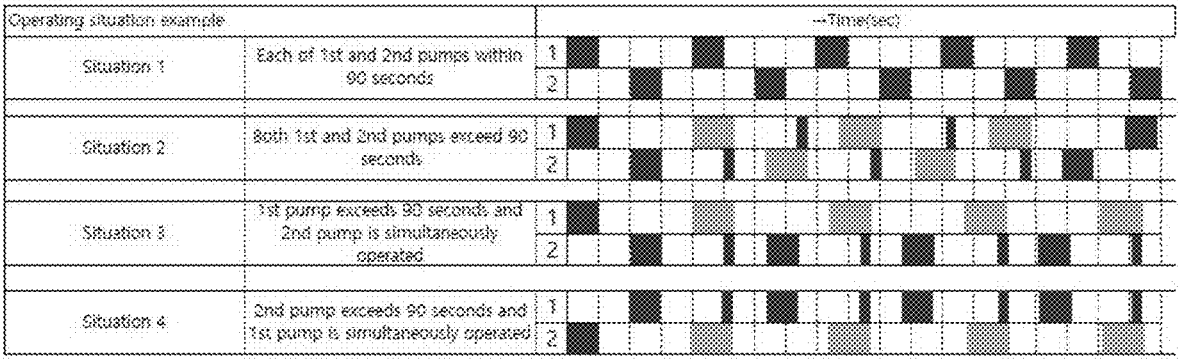
FIG. 3 is an example diagram a pump driving situation according to the present disclosure.

FIG. 2 is a block diagram illustrating an overall configuration of the controller of the system according to the present disclosure, and FIG. 3 is an example diagram a pump driving situation according to the present disclosure.

Referring to FIGS. 2 and 3, the controller 3 according to the present disclosure may include an operating time acquisition module 100, a first determination module 200, a second determination module 300, and a driving control module 400.

The operating time acquisition module 100 serves to acquire the operating time of each of the first and second pumps 1 and 2. Here, the operating time may refer to a time for which each of the first and second pumps 1 and 2, which are run in an alternating manner, is operated one time or a time for which the first and second pumps 1 and 2 are operated consecutively.

For example, when the first pump 1 is operated from 13:59:10 to 14:00:00, the operating time may be determined to be 50 seconds. Furthermore, it is also possible to acquire the operating time in the form of on and off points in time, such as operation start at 13:59:10 and operation end at 14:00:00.

Thus, acquiring the operating time of each of the first and second pumps 1 and 2 means acquiring whether or not each of the first and second pumps 1 and 2 is operated (i.e., on and off states of the first and second pumps 1 and 2) and simultaneously acquiring a time for which each of the first and second pumps 1 and 2 is maintained in the on state (i.e., a time for which each of the first and second pumps 1 and 2 is maintained in the on state during the alternating period of the first and second pumps 1 and 2).

The on and off driving of the pumps over time is shown in the table of FIG. 3 in which example pump driving situations are illustrated. Here, each block in the table indicates 90 seconds related to the above-described situation. The portions of the table indicated with colored blocks are operating times, respectively. That is, a first block filled with the first pump 1 may indicate that the first pump 1 is operated for 90 seconds. A non-colored blank block indicates an off state.

As illustrated in FIG. 3, the operating time of each of the first and second pumps 1 and 2 may be acquired. The operating time may be a concept including not only a length of time for which the corresponding pump is maintained in the on state but also a point in time at which the pump is set to the on state and a point in time at which the pump is set to the off state.

The first determination module 200 serves to compare the operating time of each of the first and second pumps 1 and 2, determined by the above-described operating time, with a predetermined reference time and perform first determination of whether or not each of the first and second pumps 1 and 2 is operating normally.

As illustrated in FIG. 3, assuming that the predetermined reference time for each of the first and second pumps 1 and 2 is 90 seconds, when the operating time of any pump exceeds 90 seconds, the pump is determined to not be operating normally.

That is, in Situation 1 in FIG. 3, both the first and second pumps 1 and 2 are operating normally, since both the first and second pumps 1 and 2 operate within 90 seconds. In contrast, in Situation 2, orange-colored portions indicate that the operating time of each of the first and second pumps 1 and 2 exceeds the reference time. In Situation 3, the operating time of the first pump 1 exceeds the reference time. In Situation 4, the operating time of the second pump 2 exceeds the reference time. That is, when the operating time exceeding the reference time is shown, the operation is determined to be an abnormal operation. When the operating time is equal to or shorter than the reference time, the operation is determined to be a normal operation.

Here, the reference time is not limited, a reference number may be set by a system operator, depending on the type of the pump, the environment of installation, the old state of the pump, or a pressure to be applied.

The second determination module 300 serves to determine the number of simultaneous operations in which the first and second pumps are operated simultaneously on the basis of the above-described operating time and perform second determination of whether or not the pump is operating normally by comparing the determined number with the reference number. In this regard, the second determination module 300 includes a simultaneous operation acquisition portion 310 and a second determination portion 320.

The simultaneous operation acquisition portion 310 acquires the number of simultaneous operations in which the first and second pumps 1 and 2 are operated simultaneously, on the basis of the operating time of each of the first and second pumps 1 and 2 determined by the operating time acquisition module 100.

This can be seen from the illustration of FIG. 3. Although Situation 1 illustrates an example in which the first pump 1 and the second pump 2 are separately operated in an alternating manner, each of Situations 2, 3, and 4 illustrates areas in each of which an area in which the first pump 1 is in the on state overlaps an area in which the second pump 2 is in the on state. That is, this indicates the simultaneous operation in which the second pump 2 is operating simultaneously with the operation of the first pump 1.

Here, in Situation 2, a total of five (5) simultaneous operations occurs. In particular, 5 consecutive simultaneous operations occur. That is, it may be regarded that overlapping of a section in which the first pump 1 is in the on state with a section in which the second pump 2 is in the on state is consecutively repeated five (5) times. That is, after the first occurrence of the simultaneous operation, the simultaneous operation consecutively occurs at each section in which the first pump 1 is in the on state (i.e., each section in which the first pump 1 is operated). This is the same when described with respect to the second pump 2.

That is, in a situation in which the on and off states of each of the first and second pumps 1 and 2 is repeated, in an alternating operation, when the first pump 1 is in the on state, the second pump 2 needs to be in the off state. In contrast, when the first pump 1 is in the off state, the second pump 2 needs to be in the on state. However, in Situation 2 in which the on and off states of the first and second pumps 1 and 2 are repeated in different periods, the on period is consecutively repeated 5 times.

This is referred to as the number of consecutive simultaneous operations. In Situation 2, the number of consecutive simultaneous operations is 5 with respect to the first pump 1 and 5 with respect to the second pump 2. That is, the number of consecutive simultaneous operations is the same as or smaller than the number of simultaneous operations.

Referring to Situation 3, the number of simultaneous operations of the first and second pumps 1 and 2 is 4. However, the number of consecutive simultaneous operations of the first pump 1 is also 4, and the number of simultaneous operations of the second pump 2 is also the same, i.e., 4. However, the number of consecutive simultaneous operations is 0. With respect to the second pump, in the repetition of the on and off states, the consecutive repetition of the on period does not occur.

Referring to Situation 4, the number of simultaneous operations of the first and second pumps 1 and 2 is also 4. However, the number of consecutive simultaneous operations of the first pump 1 is 0, and the number of consecutive simultaneous operations of the second pump 2 is 4.

This situation is opposite Situation 3. With respect to the first pump 1, the consecutive overlapping of the on period in the repetition of the on and off states does not occur. In contrast, with respect to the second pump 2, the simultaneous operation consecutively occurs in each on period after the initial simultaneous operation. Thus, the number of consecutive simultaneous operations is 4.

Thus, the number of simultaneous operations based on the above-described operating time for which the first and second pumps 1 and 2 are simultaneously operated, as well as the number of consecutive simultaneous operations in which simultaneous operations consecutively occur with respect to each of the first and second pumps 1 and 2, are acquired by the simultaneous operation acquisition portion 310.

The second determination portion 320 performs the second determination of whether or not the operation is normal by comparing the number of simultaneous operations determined by the simultaneous operation acquisition portion 310 with the predetermined reference number. Since the number of simultaneous operations of the first and second pumps 1 and 2 is determined by the above-described simultaneous operation acquisition portion 310, the second determination of whether or not the operation is normal is performed by comparing the number of simultaneous operations with the reference number.

In a situation in which the reference number of the ordinary operation is 5, the operation may be determined to be normal when the number of simultaneous operations is equal to or smaller than 5, and determined to be abnormal when the number of simultaneous operations is greater than 5.

Since the reference number is not limited like the above-described reference time, the reference number may be set by the system operator, depending on the type of the pump, the environment of installation, the obsolescent condition of the pump, or a pressure to be applied.

When the number of simultaneous operations equal to the reference number is determined to be 5, in Situation 1, both the first and second pumps 1 and 2 are determined to be operating normally. In Situation 2, both the first and second pumps 1 and 2 are determined to be operating abnormally. In Situations 3 and 4, both the first and second pumps 1 and 2 are determined to be operating normally.

Alternatively, since the number of consecutive simultaneous operations may be determined by the simultaneous operation acquisition portion 310, the second determination of whether or not the operation is normal may be performed on the basis of the determined number of consecutive simultaneous operations. Here, the reference number may be set to be, for example, 3 like the number of consecutive simultaneous operations.

Here, in the above-described embodiment of FIG. 3, in Situation 1, both the first and second pumps 1 and 2 are determined to operate normally. In Situation 2, both the first and second pumps 1 and 2 are determined to operate abnormally. In Situation 3, the first pump 1 is determined to operate abnormally, whereas the second pump 2 is determined to operate normally. In Situation 4, the first pump 1 is determined to operate normally, whereas the second pump 2 is determined to operate abnormally.

Here, only when the operation is determined to be normal by both the first determination module 200 and the second determination module 300, the corresponding pump may be determined to be operating normally. Alternatively, when the operation is determined to be normal by one of the first determination module 200 and the second determination module 300, the corresponding pump may be determined to be operating normally.

In other words, when the first determination module 200 determines that the first pump 1 is operating normally, the operation may be directly determined to be normal, and thus the second determination module 300 may not determine whether or not the operation is normal. Alternatively, even when the first determination module 200 determines that the first pump 1 is operating normally, the second determination of whether or not the operation is normal may be performed by the second determination module 300. After the operation is determined to be normal by the second determination module 300, the operation may be finally determined to be normal.

In addition, in a situation in which the operation is determined to be abnormal by the determination module 200, when the operation is determined to be normal by the second determination module 300, the operation may be determined to be normal or abnormal. The determination may vary depending on set values of the controller 3. Here, a method of setting the set values is not limited, and may be fundamentally set by the system operator.

Thus, AND/OR methods may be applied to the determination of whether or not the operation is normal by the first determination module 200 and the second determination module 300. In the AND method, only when the operation is determined to be normal by the first determination module 200 and by the second determination module 300, the operation may be determined to be normal. In the OR method, when the operation is determined to be normal by the first determination module 200 or by the second determination module 300, the operation may be determined to be normal.

Furthermore, as required, whether or not respective operations are normal may be determined by the first determination module 200 and by the second determination module 300. It is also possible to determine whether or not respective operations are normal by one of the first determination module 200 and the second determination module 300.

The driving control module 400 serves to differentially control the driving of the first pump 1 and the driving of the second pump 2 according to the result of the above-described determination of whether or not the operation is normal by the first determination module 200 and the second determination module 30. Particularly, the operation is controlled differentially by maintaining the current set state when the operation is determined to be normal and changing the operating time set values, the operating periods, or the like of the first and second pumps 1 and 2 when the operation is determined to be abnormal.

For example, when the first pump 1 is determined to be operating abnormally, the operating load of the first pump 1 may be reduced by relatively reducing the operating time of the first pump 1 and increasing the operating time of the second pump 2. Alternatively, the first pump 1 may be turned off and the second pump 2 may be operated alone.

Alternatively, in order to reduce the number of consecutive simultaneous operations, it is also possible to adjust the number of the consecutive simultaneous operations to be less than the reference number by controlling the on/off periods of the first and second pumps 1 and 2 by the driving control of the first and second pumps 1 and 2.

In the dual pump smart control system according to the present disclosure, the operating time and the number of simultaneous operations are analyzed and compared with the reference time and the reference number, so that the controller 3 determines whether or not the operation is normal. Afterwards, the driving of the first pump 1 and the driving of the second pump 2 are differentially controlled depending on whether or not the operation is determined to be normal by the controller 3. Thus, a malfunction that would be caused by the concentration of load at a specific pump may be prevented. Accordingly, the dual pump smart control system can precisely control the driving of the dual pumps and enable the pumps to operate efficiently.

Figure 4:
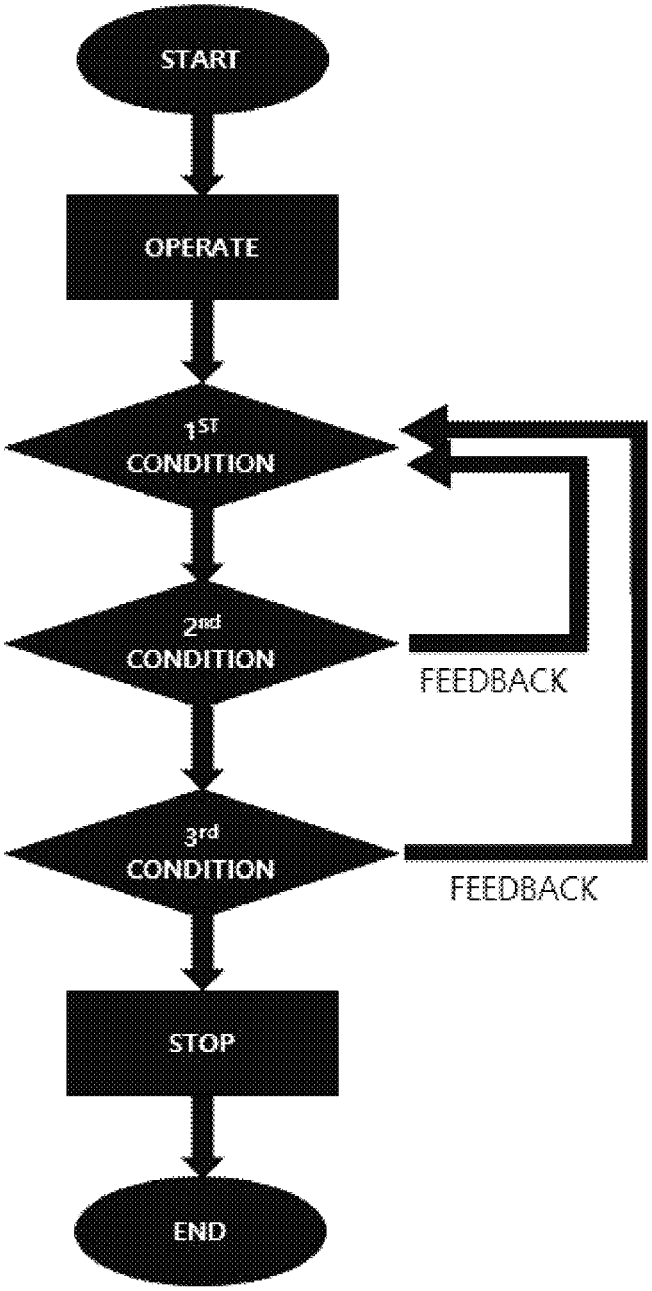
FIG. 4 is a process diagram illustrating the system according to the present disclosure.

FIG. 4 is a process diagram illustrating the system according to the present disclosure.

Referring to FIG. 4 together with FIG. 3, the controller 3 according to the present disclosure includes a third determination module 500, and may determine whether or not the operation is normal by the third determination module 500, in addition to the determination of whether or not the operation is normal by the first determination module 200 and the second determination module 300.

Here, the determination of whether or not the operation is normal by the third determination module 500 may be performed on the basis of a duty ratio. The third determination module 500 determining whether or not the operation is normal on the basis of the duty ratio may include a duty ratio input portion 510, a duty ratio acquisition portion 520, and a third determination portion 530.

The input portion 510 performs an operation of receiving duty ratios set for the first and second pumps 1 and 2, respectively. This operation may set the duty ratios for the first and second pumps 1 and 2 in the controller 3. Thus, values of the duty ratios input by the system operator or input as set values of the controller become set duty ratios.

Here, the set duty ratios may refer to set operation efficiencies. In other words, in the first and second pumps 1 and 2 in which pulses of repeating on/off signals occur, the set duty ratios may be set values for amounts of power applied to the first and second pumps 1 and 2 or set values for pulse frequencies applied to the first and second pumps 1 and 2.

The duty ratio acquisition portion 520 serves to acquire real-time duty ratios of the first and second pumps 1 and 2 on the basis of the operating times acquired by the operating time acquisition module 100 and the set duty ratios input by the duty ratio input portion 510.

Here, the real-time duty ratios may be duty ratio values actually occurring when set duty ratios are input and the first and second pumps 1 and 2 are actually driven. Theoretically, the real-time duty ratio should be equal to the set duty ratio. It should not be understood that the real-time duty ratio is the same as the set duty ratio although the real-time duty ratio may be similar to the set duty ratio.

In addition, the real-time duty ratios are also obtained in comparison with the acquired operating time. In the components related to the acquisition of the operating time, whether or not each of the first and second pumps 1 and 2 is operated (i.e., on and off states of the first and second pumps 1 and 2) is acquired, and the entirety of times for which the first and second pumps 1 and 2 are maintained in the on state (i.e., times for which the first and second pumps 1 and 2 are maintained in the on state during the alternating periods of the first and second pumps 1 and 2) are simultaneously acquired.

Thus, the function of the duty ratio acquisition portion 520 may include acquiring the on and off states of the first and second pumps 1 and 2 occurring together with pulses and simultaneously acquiring the real-time duty ratios occurring through comparison with the set duty ratios (i.e., set duty ratio values).

Here, the real-time duty ratios may be measured from the operating first and second pumps 1 and 2 using a conventional duty ratio measuring device or program, and methods and devices for measuring the real-time duty ratios are not limited.

Alternatively, in a simplest manner, the duty ratios may be acquired by comparing the operating efficiencies of the first and second pumps 1 and 2 which are actually operating. For example, the duty ratios may be acquired in real time by the following example equation 1:

$$D_1=(t_1/t_2)\times 100 \quad (1),$$

where $D_1$ indicates a duty ratio of the first pump, $t_1$ indicates a single operating time of the first pump, and $t_2$ indicates a single operating time of the second pump.

That is, the duty ratios are compared by comparing the single operating times of the first and second pumps 1 and 2, the on and off states of which are repeated in the form of pulses. Here, the single operating time means the single operating time within a specific time range.

For example, referring to the illustration of FIG. 3, in Situation 1, in the range of 0 to 270 seconds, the real time duty ratio of the first pump 1 is 50%, and the real time duty ratio of the second pump 2 is also 50%. However, when a different time range is set, the real-time duty ratios may also be determined to be different.

However, the real-time duty ratios may be determined or measured in a variety of other methods in addition to the above-described method, and the present disclosure is not limited to the above-described method.

The third determination portion 530 performs third determination of determining whether or not the operation is normal by comparing the reference duty ratio set by the input portion 510 and a real-time duty ratio acquired by the duty ratio acquisition portion 520. For example, in a situation in which the reference duty ratio is 70%, the operation is determined to be abnormal when the real-time duty ratio of a specific pump exceeds 70%.

As in the above illustration, in Situation 1, in the range of 0 to 270 seconds, the real-time duty ratio of the first pump 1 is 50%, and the real time duty ratio of the second pump 2 is also 50%. Thus, in Situation 1, both the first and second pumps 1 and 2 may be determined to be operating normally.

However, referring to, for example, Situation 2, when the real-time duty ratio of the first pump 1 exceeds 70% in some cases, and the real time duty ratio of the second pump 2 exceeds 70% in some cases, both the first and second pumps 1 and 2 are determined to be operating abnormally.

Furthermore, in Situation 3, when the real-time duty ratio of the first pump 1 exceeds 70% in some cases, the first pump 1 may be determined to be operating abnormally. In Situation 4, the real-time duty ratio of the second pump 2 exceeds 70% in some cases, the second pump 2 may be determined to be operating abnormally.

Thus, when whether or not the operation is normal is determined by the third determination module 500 as described above, the driving control module 400 differentially controls the driving of the first pump 1 and the driving of the second pump 2 according to the results of the first, second, and third determination of whether or not the operation is normal.

As described above, the final determination of whether or not the operation is normal may be performed by the AND method of the first, second, and third determination (i.e., the operation is finally determined to be normal when determined to be normal through all of the first, second, and third determination) or the OR method of the first, second, and third determination (i.e., the operation is finally determined to be normal when determined to be normal through at least one of the first, second, and third determination).

For example, in a situation in which the first determination, the second determination, and the third determination are sequentially performed, when the operation is determined to be normal in the first determination, the operation may be determined to be normal without the second determination or the third determination. When the operation is determined to be abnormal in the first determination, the second determination may be performed. When the operation is determined to be normal in the second determination, the third determination may not be performed.

However, when the operation is determined to be abnormal in the second determination, the third determination is performed. When the operation is determined to be normal in the third determination, the operation may be finally determined to be normal. When the operation is determined to be abnormal in the third determination, the operation may be finally determined to be abnormal.

Alternatively, the first determination, the second determination, and the third determination may be sequentially performed, and the operation may be determined to be normal only when determined to be normal sequentially through the first determination, the second determination, and the third determination. The operation may be determined to be abnormal when determined to be abnormal in only one of the first determination, the second determination, and the third determination.

In this case, particularly, as the operation is determined to be abnormal, the driving control module 400 may stop the operation of a specific pump determined to be operating abnormally by differentially controlling the driving of the first pump 1 and the driving of the second pump 2. Alternatively, when a specific pump is determined to be operating abnormally, the driving control module 400 may support the function of the specific pump by simultaneously operating the other pump.

That is, as described above, the driving of the first pump 1 and the driving of the second pump 2 are differentially controlled by maintaining the current state when the operation is determined to be normal and changing the operating time set values, the operating periods, or the like of the first and second pumps 1 and 2 when the operation is determined to be abnormal.

For example, when the first pump 1 is determined to be operating abnormally, the operating load of the first pump 1 may be reduced and the load of the second pump 2 may be relatively increased by reducing the operating time of the first pump 1 and increasing the operating time of the second pump 2. Alternatively, the first pump 1 may be turned off, and the second pump 2 may be operated alone.

Alternatively, in order to reduce the number of consecutive simultaneous operations, it is also possible to adjust the number of the consecutive simultaneous operations to be less than the reference number by controlling the on/off periods of the first and second pumps 1 and 2 by the driving control of the first and second pumps 1 and 2.

In addition to the configuration of determining whether or not the operation is normal on the basis of the duty ratio, the driving may be precisely controlled by rapidly detecting the concentration of load applied to a specific pump and determining whether or not the operation is normal according to the detection, so that the specific pump may be prevented from the concentration of load or fatigue. Consequently, the pump can be prevented from malfunctioning, and thus the lifetime of the pump can be increased.

Furthermore, the controller 3 may include a feedback module 600. The feedback module 600 is configured to repeatedly perform determining whether or not the operation is normal. That is, as whether or not each of the first and second pumps 1 and 2 is operating normally is determined by the first determination module 200, the second determination module 300, and the third determination module 500, whether or not the operation is normal may be re-determined by the first determination module 200.

Specifically, when whether or not each of the first and second pumps 1 and 2 is operating normally is determined by the first determination module 200, the second determination module 300, and the third determination module 500, the determination of whether or not the operation is normal is not stopped but whether or not the operation is normal is re-determined by the first determination module 200. Thus, whether or not the operation is normal may be performed consecutively, instead of being performed one time.

Furthermore, when re-determination of whether or not the operation is normal by the first determination module 200 is caused by the feedback module 600, subsequent re-determination of whether or not the operation is normal by the second determination module 300 and the third determination module 500 may also be sequentially performed. Consequently, consecutive monitoring on the determination of whether or not the operation is normal can be performed.

MUM In addition, when whether or not the operation is normal is performed, it is necessary to uniformize output levels of the pumps by reducing the operating load of one pump determined to be operating abnormally while temporarily increasing the load of the other pump. In this regard, the driving control module 400 may include an additional function for the driving control.

For example, when the first pump 1 is determined to be operating abnormally, the driving control module 400 may differentially control the driving of the first pump 1 and the driving of the second pump 2 so that the alone operation of the second pump 2 alternates with the simultaneous operations of the first and second pumps 1 and 2. That is, the second pump 2 may be operated continuously while the first pump 1 may be repeatedly turned on and off in the form of pulses repeating with a period, so that the alone operation of the second pump 2 alternates with the simultaneous operations of the first and second pumps 1 and 2.

In contrast, when the second pump 2 is determined to be operating abnormally, the driving of the first pump 1 and the driving of the second pump 2 are differentially controlled so that the alone operation of the first pump 1 alternates with the simultaneous operations of the first and second pumps 1 and 2.

Consequently, the driving load of the pump determined to be operating abnormally may be reduced, and the pump determined to be operating abnormally may be assisted by or replaced with the pump determined to be operating normally. It is possible to constantly uniformize the flow rate of fluid supplied or discharged by the pumps, thereby preventing the pumps from malfunctioning, overloading, and the accumulation of fatigue.

Figure 5A:
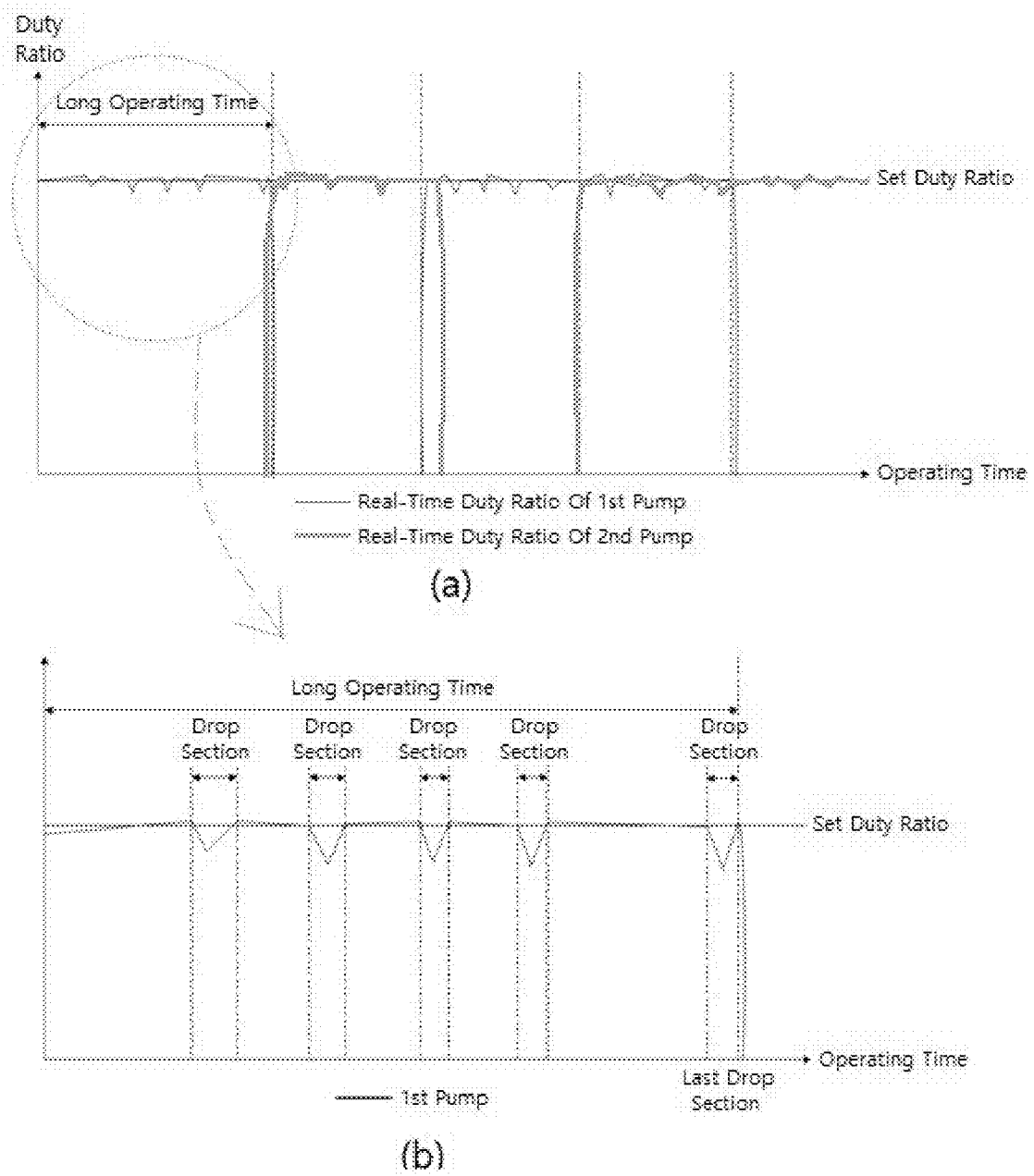
FIG. 5A shows graphs illustrating the duty ratios over the operating times.
Figure 5B:
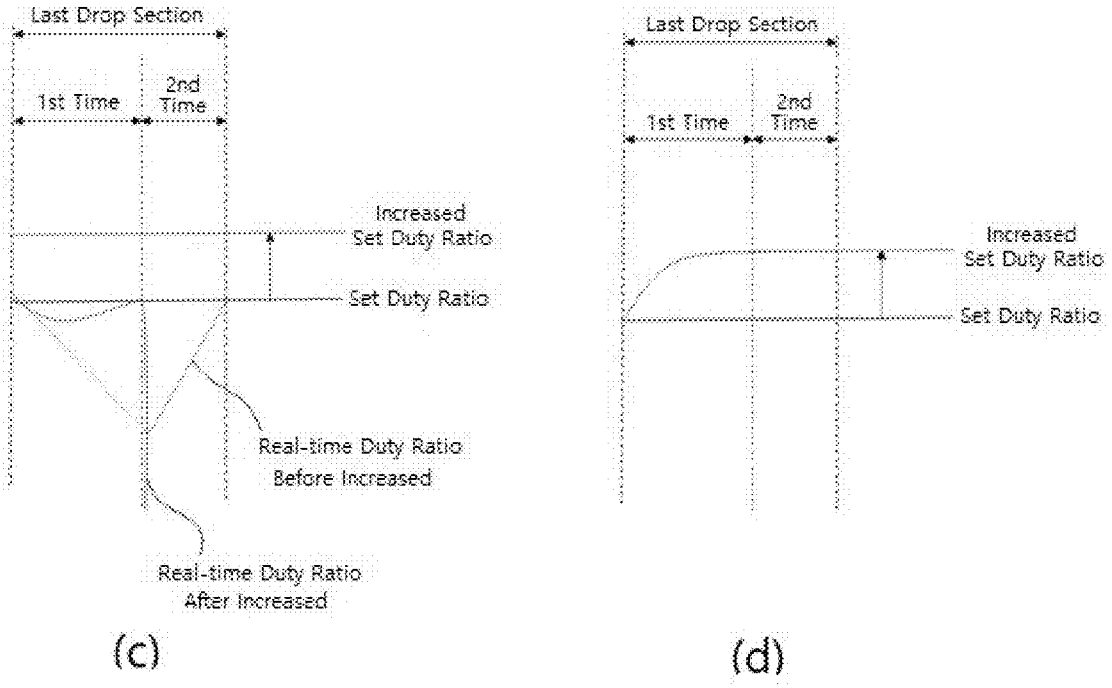
FIG. 5B shows graphs illustrating last drop section adjustment.

FIG. 5A shows graphs illustrating duty ratios over the operating times, and FIG. 5B shows graphs illustrating last drop section adjustment.

Referring to FIGS. 5A and 5B, the controller 3 according to the present disclosure may be configured to enable learning by drawing the duty ratio over the operating times on the graphs and, when the real-time duty ratio is lower than the reference duty ratio, re-adjust the operating time and the set duty ratio. In this regard, the controller 3 may include a learning module 700 and a driving re-adjustment module 800.

The learning module 700 includes a data generator 710 and a drop section acquisition portion 720. The learning module 700 learns the duty ratio with respect to the past operating time as data, and determines a section in which the real-time duty ratio is lower than the reference duty ratio at a past point in time to be a drop section.

The data generator 710 serves to generate data in which the duty ratios over the operating times of the first and second pumps 1 and 2 operated in the past are drawn on a single graph and store the generated data in a learning DB.

Here, the duty ratios on the graph include real-time duty ratios and set duty ratios. Thus, set duty ratio values of the first and second pumps 1 and 2 operated in the past and real-time duty ratio values are on the single graph. Here, the real-time duty ratio values of each of the first and second pumps 1 and 2 may be illustrated on the single graph.

That is, the X-axis is the operating times, whereas the Y-axis is the duty ratios. Here, it can be seen from FIG. 5A that all of the real-time duty ratios and the set duty ratio values of the first and second pumps 1 and 2 are on the graph.

Here, referring to the graph of the real-time duty ratios of the first pump 1 and the second pump 2, as the first and second pumps 1 and 2 are periodically turned on and off, the real-time duty ratio of the second pump 2 is 0 in the operating time for which the first pump 1 is operating alone (i.e., the operating time of the first pump 1 alone). In the operating time of the second pump 2 alone, the real-time duty ratio of the first pump 1 is 0.

Thus, in the first and second pumps 1 and 2 operating in an alternating manner, the operating time in which each of the first and second pumps 1 and 2 operates alone (hereinafter, referred to as the "alone operating time") may be reviewed. The alone operating time may be a type of section from a point in time at which a specific pump is turned on to a point in time at which the pump is turned off.

The graph generated in this manner is stored as learning data in the learning DB. In this regard, the learning DB may work in concert with a storage device, such as a memory, separately provided in the controller 3, so that the learning data is stored in the storage device.

Furthermore, the data generated in this manner may be categorized and stored according to time, date, week, month, or the set duty ratio. Thus, the learning data stored in the learning DB means various data regarding the duty ratio over the operating time in the past. Learning for past driving situations may be performed by storing the learning data in the learning DB.

The drop section acquisition portion 720 acquires the alone operating time of the first pump 1, i.e., the time for which the first pump 1 has been operated alone, from changes in the real-time duty ratio of the first pump 1 acquirable from the above-described graph.

This may be referred to as a section in which the first pump 1 remains in the on state alone and the second pump 2 remains in the off state as described above. Thus, in this section, the real-time duty ratio of the second pump 2 may be 0.

Here, in the periodic operation of the first pump 1, the lengths of the alone operating times may be the same or different. Here, the longest operating time of the alone operating times of the first pump 1 is extracted as a long operating time.

The extracted long operating time may be a subject of analysis. The graph of the extracted long operating time may be illustrated in FIG. 5B. Here, the long operating time may be regarded as being the longest single operating time of the single operating times during each of which the first pump 1 is turned on and then off one time. That is, the operating time for which the on state is maintained for the longest time is extracted as the long operating time.

Here, it is theoretically required that the real-time duty ratio maintains the same value during the long operating time. However, in reality, the real-time duty ratio may be reduced due to changes in the external environment, operating conditions of the pump, the accumulated fatigue of the pump, or the like, as illustrated in FIG. 5B.

Thus, a section in which the real-time duty ratio is lower than the reference duty ratio in the long operating time is referred to as a drop section. Here, the drop section indicates a section from a point in time at which the real-time duty ratio is reduced to be lower than the set duty ratio and to a point in time at which the real-time duty ratio is returned to the reference duty ratio, on the graph from which the long operating time is extracted.

That is, the section having the real-time duty ratio lower than the set duty ratio is regarded as the drop section. Here, in general, a plurality of drop sections may be generated.

Thus, it may be understood that the learning module 700 learns and processes past data (i.e., learning data at a past point in time). Through learning of the past data, the learning module 700 may serve as a fundamental component for the re-adjustment of the set duty ratio by the driving re-adjustment module 800.

The driving re-adjustment module 800 may serve to reduce the time length of the drop section and increase the set duty ratio by adjusting and increasing the set duty ratio. In this manner, the driving re-adjustment module 800 may increase the real-time duty ratio and simultaneously prevent the first pump 1 from being overloaded.

In this regard, learning data having the same set duty ratio as the current set duty ratio (i.e., the set duty ratio at the current point in time) should be selectively extracted from the learning data stored through the learning module 700. That is, the set duty ratio input by the input portion 510 is the current set duty ratio, the learning data, the set duty ratio of which is the same as the set duty ratio set by the input portion 510, is extracted.

That is, the learning data having the same set duty ratio as the current set duty ratio may be extracted from the stored learning data regarding the past driving situations, and as in the drop section of the learning data, the operating time and the set duty ratio of the first pump 1 may be re-adjusted.

In the drop section acquisition portion 720 analyzing the learning data as described above, a plurality of drop sections in the long operating time of the learning data are determined. Thus, it is possible to determine how many drop sections are provided for the past learning data having the same set duty ratio.

Thus, on the basis of the above features, the adjustment is performed so that the set duty ratio is increased and the time of the last drop section of the plurality of drop sections is reduced. Here, reducing the time of the last drop section may mean reducing the operating time of the first pump 1 in the last drop section and increasing the set duty ratio in the corresponding drop section, thereby boosting the first pump 1 for a short time.

Here, the last drop section may be the last drop section of the plurality of drop sections in the long operating time included in the above-described learning data. Particularly, the last drop section may be the fourth or fifth drop section.

That is, the selection of the last drop section may vary depending on the number of drop sections acquired from the learning data. When five drop sections are acquired from the learning data, the last drop section may be the fifth drop section. When four drop sections are acquired from the learning data, the last drop section may be the fourth drop section. Thus, conditions for selecting the last drop section are not limited, and may vary depending on the number of drop sections determined on the basis of the learning data.

That is, values are adjusted so as to reduce the time of the last drop section acquired from the learning data and increase the set duty ratio of the last drop section. The adjusted values may be equally applied to the operating first pump 1, thereby re-adjust the driving of the first pump 1 in the same manner as reducing the time of the last drop section of the learning data learned in the past and increasing the set duty ratio of the last drop section.

That is, the operating time and the set duty ratio of the first pump 1 may be re-adjusted so that the time of the last drop section in the learning data is reduced and the set duty ratio of the last drop section is increased, and the re-adjusted values are applied to the first pump 1 that is currently operating.

Thus, due to the above-described driving re-adjustment module 800, in a situation in which the real-time duty ratio equal to or less than the set duty ratio repeatedly occurs (i.e., a situation in which the drop section repeatedly occurs) in the first pump 1 that is difficult to properly operate due to excessive fatigue or load, the first pump 1 may be strongly boosted by reducing the time (or length) of the last drop section and increasing the set duty ratio in the corresponding section. At the same time, load applied to the first pump 1 may be minimized.

Here, more specifically, in the time adjustment of the drop section, boosting, and driving adjustment by the driving re-adjustment module 800, control may be adjusted according to specific configurations of a time adjustment portion 810 and a simultaneous driving controller 820.

The time adjustment portion 810 divides the time of the last drop section into a first time for which the first pump 1 is boosted and a second time for which the first pump 1 is cooled down.

That is, during the first time, the first pump 1 may be strongly boosted by the adjusted set data, thereby increasing the real-time duty ratio. During the second time, the driving of the first pump 1 may be stopped and the first pump 1 may be cooled down so as to remove fatigue accumulated in the first pump 1.

Thus, reducing the time of the drop section with respect to the drop section means that the length of the operating time of the drop section is reduced to match the first time. During the second time, the driving of the first pump 1 is stopped, and the cooling down of the first pump 1 is performed.

Accordingly, the simultaneous driving controller 820, which is a specific component for this purpose, serves to simultaneously drive the first and second pumps 1 and 2 during the first time and only drive the second pump 2 during the second time. In other words, during the first time that may be referred to as a boost time, not only the first pump 1 but also the second pump 2 is driven so as to effectively boost the real-time duty ratio and, at the same time, pre-heat the second pump 2 that is to be operated alone in the subsequent second time. During the second time, the second pump 2 is driven alone so as to prevent the real-time duty ratio from be reduced.

Furthermore, the first time should necessarily be smaller than the time of the last drop section. This is because the time of the last drop section is divided into the first time and the second time. Consequently, the time during which the first pump 1 is operated in the last drop section is reduced.

Here, particularly, the time adjustment portion 810 may adjust the first time by the following Equation 1:

$$T_1=10F\times\tanh(d/t_1) \quad (1),$$

where $T_1$ indicates a length of the first time, F indicates a time length of the drop section, $t_1$ indicates a length of the long operating time, d indicates the drop section.

Here, the time adjustment portion adjusts the first time to be proportional to the number of drop sections by the hyperbolic tangent function. Thus, the time adjustment portion may prevent the first pump 1 from being boosted too rapidly and minimize rapid weighting of load applied to the first pump 1 by configuring the first time to be increased with increases in the number of drop sections.

In addition, with respect to the entire time length of the drop section, for example, when the time length of the drop section is 3 seconds, the length of the long operating time is 90 seconds, and the number of drop sections is 5, $T_1$ may be obtained as follows:

$$T_1=10\times3\times\tanh(5/90)=1.66 \text{ (seconds)}$$

Here, comparison processing is performed to the length of the long operating time and the number of drop sections acquired in a corresponding long operating time by the hyperbolic tangent function. At the same time, in consideration that the hyperbolic tangent value is significantly small, correction is performed by multiplication with a weight 10 and the resultant value is multiplied with the time length of the drop section.

Furthermore, here, the length of the second time may be obtained by subtracting the time length of the obtained first time from the time length of the drop section. In the above illustration, the time length of the drop section is determined to be 3 seconds, and the time length of the first time is determined to be 1.66 seconds. Thus, the time length of the second time may be determined to be 1.34 seconds.

In addition, in the division of the time length of the drop section into the first time and the second time, the length of the first time cannot be obtained by simply multiplying or dividing the length of the long operating time with the number of drop sections.

Thus, when a value of the equation input the above-described hyperbolic tangent function, i.e., a value obtained by dividing the number of drop sections with the length of the long operating time, is simply multiplied with the time length of the drop section, a value 0.17 second is obtained. This result is also not appropriate.

Thus, when the comparison processing is performed using a value of the hyperbolic tangent function, the value may be multiplied with a suitable correction value, so that the balance between the first time and the second time may be obtained.

Furthermore, the driving re-adjustment module 800 further includes a duty ratio adjustment portion 830 adjusting and increasing the set duty ratio of the first time by the following Equation 2.

That is, the set duty ratio during the first time may be precisely controlled by the duty ratio adjustment portion 830. Here, the set duty ratio is precisely controlled by Equation 2:

$$S_T = S_0 \tanh(5T/T_1) \quad (2),$$

where $S_T$ indicates the set duty ratio over time, $S_0$ indicates a set duty ratio value adjusted to be increased in the system, $T_1$ indicates a length of the first time, and T indicates a time length consumed from a start point in time of the drop section.

Here, when the set duty ratio value set to be increased in the system is 60% (with respect to the operation efficiency), the length of the first time is 1.66 seconds, and the time length consumed from the start point in time of the drop section is 0.25 second, the set duty ratio with respect to 0.25 second is as follows.

$$S_{0.25} = 60 \times \tanh(5 \times 0.25/1.66) = 38.22$$

That is, the set duty ratio at a point in time after 0.25 second from the start point in time of the drop section may be calculated to be 38.22%.

Thus, in Equation 2 as described above, when the length of the first time is 1.66 seconds, the set duty ratio value gradually increases over time from the start point in time of the drop section. Finally, the set duty ratio value converges to the value of the set duty ratio processed to increase in the system.

Here, the set duty ratio significantly increases in the early stage, but gradually converges to the value of the set duty ratio processed to increase in the system. Thus, drive force is provided due to the set duty ratio being processed to increase in the early stage, and such an increase is gradually reduced over time.

When the set duty ratio is simply increased in a linear form, the linear form is increased and maintained without a section in which a significant change is reduced. There is a drawback in that this feature is not natural for typical value changes and adaptive processing. Boost processing is performed using the hyperbolic tangent function so that drive force is provided by a strong boost in the early stage and the rising slope is gradually reduced. In this manner, by providing the drive force in the early stage and gradually reducing the drive force, the set duty ratio can be naturally increased.

The configurations and functions of the dual pump smart control system according to the present disclosure have been described with reference to the drawings. It should be understood, however, that the foregoing descriptions are illustrative only, and the technical idea of the present disclosure is not limited to the foregoing descriptions or the accompanying drawings. Those having ordinary knowledge in the art will appreciate that various modifications and changes in forms are possible without departing from technical idea of the present disclosure.

What is claimed is:

1. A dual pump smart control system comprising:

first and second pumps; and a controller, wherein the controller comprises:

an operating time acquisition module to acquire operating times of the first and second pumps;

a first determination module to perform first determination of whether or not an operation is normal by comparing the operating times with predetermined reference times;

a second determination module comprising a simultaneous operation acquisition portion to acquire the number of simultaneous operations of the first and second pumps on basis of the operating times and a second determination portion to perform second determination of whether or not the operation is normal by comparing the number of the simultaneous operations with a predetermined reference number;

a third determination module comprising a duty ratio input portion to receive set duty ratios of the first and second pumps, a duty ratio acquisition portion to acquire real-time duty ratios of the first and second pumps on basis of the operating time and the set duty ratios, and a third determination portion to perform third determination of whether or not the operation is normal by comparing the real-time duty ratios and predetermined reference duty ratios;

a driving control module to differentially control the driving of the first pump and the driving of the second pump according to a result of the determination of whether or not the operation is normal;

a learning module comprising a data generator to generate data in which duty ratios over the operating times of the first and second pumps operated in the past are drawn on a single graph and store the generated data in a learning database and a drop section acquisition portion to extract a longest long operating time among the operating times in which the first pump is operating alone from the graph and acquire a plurality of drop sections each having a real-time duty ratio lower than the set duty ratio from the long operating time; and a driving re-adjustment module to increase the set duty ratios and reduce a time of the last drop section of the plurality of drop sections by extracting learning data, set duty ratios of which are the same as the set duty ratios received by the duty ratio input portion, and re-adjusting the operating times and the set duty ratios of the first pump.

2. The dual pump smart control system of claim 1, wherein the controller comprises a feedback module to re-determine whether or not the operation is normal by the first determination module when each of the first and second pumps is determined to be operating normal by each of the first determination module, the second determination module, and the third determination module.

3. The dual pump smart control system of claim 1, wherein, when the first pump is determined to be operating abnormally, the driving control module differentially controls the driving of the first pump and the driving of the second pump so that an alone operation of the second pump alternates with simultaneous operations of the first and second pumps.

4. The dual pump smart control system of claim 1, wherein the driving re-adjustment module comprises:

a time adjustment portion to divide the time of the last drop section into a first time in which the first pump is boosted and a second time in which the first pump is cooled down; and a simultaneous driving controller to simultaneously drive the first and second pumps in the first time and only drive the second pump in the second time.

5. The dual pump smart control system of claim 4, wherein the time adjustment portion adjusts the first time by the following Equation 1:

$$T_1=10F\times\tanh(d/t_1) \quad (1),$$

where $T_1$ indicates a length of the first time, F indicates a time length of the drop section, $t_1$ indicates a length of the long operating time, d indicates the drop section.

6. The dual pump smart control system of claim 5, wherein the driving re-adjustment module comprises a duty ratio adjustment portion to adjust and increase the set duty ratios during the first time by the following Equation 2:

$$S_T=S_0\tanh(5T/T_1) \quad (2),$$

where $S_T$ indicates the set duty ratio over time, $S_0$ indicates a set duty ratio value adjusted to be increased in the system, $T_1$ indicates a length of the first time, and T indicates a time length consumed from a start point in time of the drop section.

* * * * *